US005372100A

United States Patent [19]

Bertelson

[11] Patent Number: 5,372,100

[45] Date of Patent: Dec. 13, 1994

[54] ENGINE VALVE TRAIN PUSHROD

[76] Inventor: Peter C. Bertelson, 30325 Ponds View Dr., Franklin, Mich. 48025

[21] Appl. No.: 41,154

[22] Filed: Jun. 4, 1993

[51] Int. Cl.[5] ..... F01L 1/14

[52] U.S. Cl. ..... 123/90.61

[58] Field of Search ..... 123/90.61, 90.62, 90.63; 74/579 R

[56] References Cited

U.S. PATENT DOCUMENTS

| | | | |
|---|---|---|---|
| 2,434,080 | 1/1948 | Rosa | 123/90.61 |
| 3,468,007 | 9/1969 | Nakamura | 123/90.61 |
| 4,186,696 | 2/1980 | Linsenmann | 123/90.61 |
| 4,453,505 | 6/1984 | Holtzberg et al. | 123/90.61 |
| 4,589,384 | 5/1986 | Ott | 123/90.61 |
| 4,794,894 | 1/1989 | Gill | 123/90.61 |
| 5,000,137 | 3/1991 | Wreinert et al. | 123/90.61 |
| 5,027,763 | 7/1991 | Mallas | 123/90.61 |
| 5,154,146 | 10/1992 | Hagerman et al. | 123/90.61 |

FOREIGN PATENT DOCUMENTS

| | | | |
|---|---|---|---|
| 155516 | 9/1984 | Japan | 123/90.61 |
| 244808 | 10/1986 | Japan | 123/90.61 |

*Primary Examiner*—Raymond A. Nelli
*Assistant Examiner*—Weilun Lo
*Attorney, Agent, or Firm*—John R. Benefiel

[57] ABSTRACT

A pushrod for an internal combustion engine valve train is described comprised of a composite rod body having spherically machined tip surfaces at either end, with thin metal end caps fit and bonded to each end.

2 Claims, 1 Drawing Sheet

ENGINE VALVE TRAIN PUSHROD

BACKGROUND OF THE INVENTION

The present invention concerns pushrods for the valve train of an internal combustion engine and more particularly pushrods formed of composite materials.

It has heretofore been proposed that internal combustion engine valve train pushrods be constructed of a composite material such as epoxy resin with embedded strands of lightweight fibers such as graphite, glass or Kevlar (TM). Such composite pushrods are described in U.S. Pat. No. 4,453,505, and U.S. Pat. No. 5,154,146.

Composite pushrods have been known to be produced by being pultruded as described in detail in U.S. Pat. No. 4,296,060 and the aforementioned U.S. Pat. No. 5,154,146. Composite pushrods so constructed are lighter and quieter than conventional steel pushrods.

The ends of the pushrods must engage the driving and driven components in the valve train and hence are provided with spherically shaped tips of a harder material such as steel or ceramic. The tips have heretofore been configured of solid pieces which are adhesively bonded to each end of a composite rod forming the main body of the pushrod. These tips are relatively costly and add significantly to the mass of the pushrod.

U.S. Pat. No. 4,186,696, Japanese Patent Publication 57-13204 dated Jan. 23, 1982, and Japanese Patent Publication 59-155516 dated Sep. 4, 1984, show composite pushrods having various forms of these solid tips affixed to either end.

One problem with the pultruded tube construction is the failure by cracking along the boundaries between fibers. This failure mode is described in U.S. Pat. No. 5,154,146. Brooming, i.e., the mushrooming of the ends, also may occur due to compression of the end of the composite rod or tube.

The tip constructions heretofore have caused at least small sections of the end of the composite tube which are unconfined by the tip to be stressed in compression such as to allow the failure by cracking and/or brooming of the embedded fibers.

Accordingly, it is an object of the present invention to provide an improved pushrod for an internal combustion engine valve train in which the total mass of the pushrod including the tips is minimized.

It is a further object of the present invention to prevent pushrod failure by cracking along the fiber boundaries and/or brooming of the ends.

It is a further object of the present invention to provide such a pushrod in which the cost of manufacture is also minimized.

SUMMARY OF THE INVENTION

The present invention comprises a composite valve train pushrod consisting of thermosetting resin rod having embedded longitudinally oriented, light-weight, high-strength fibers such as lass, graphite or Kevlar (TM). The ends of the tube or rod are machined such as to be spherically shaped, and have fit thereto a cap or tip of thin walled formed metal shaped such as to extend completely over the spherical ends. The cap is bonded in place over one or both ends of the composite tube or rod.

The formed thin wall metal caps are light-weight and inexpensive to manufacture. The total confinement of the tube or rod end prevents the brooming or interfiber cracking heretofore a problem with such pushrod constructions.

In addition, the interfitting of the spherical tube or rod end and the thin walled end cap provide a maximum area for adhesive bonding to enhance the strength of the adhesive bond therebetween.

The concept may also apply to steel pushrods in which the ends of the pushrod are spherically machined and a wear-resistant end cap of a formed thin walled metal is welded or otherwise affixed to the end such as to reduce the cost of manufacture of the pushrod.

DETAILED DESCRIPTION

In the following detailed description a particular embodiment will be described in accordance with 35 USC 112 and specific terminology employed for the sake of clarity, but it is to be understood that the same is intended to merely be illustrative, inasmuch as the invention is capable of taking many forms and variations within the scope of the appended claims.

Figure 1:
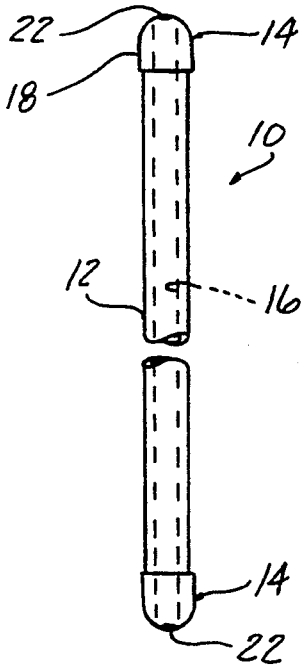
FIG. 1 is an elevational view of a pushrod according to the present invention.

Referring to the drawings and particularly FIG. 1, the pushrod 10 according to the present invention includes a tubular body 12 having spherical hollow end caps 14 affixed at either end. As is conventional, an oil passage 16 extends the length of the pushrod 10 exiting either end of the respective caps 14.

Figure 2:
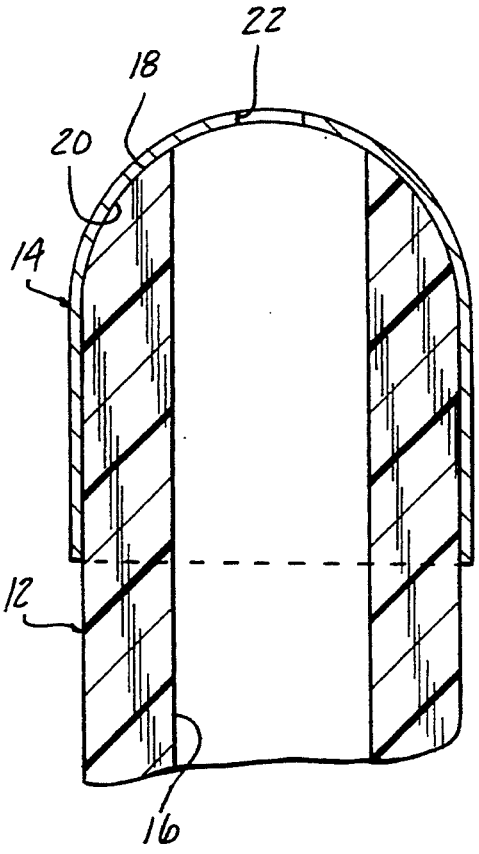
FIG. 2 is a fragmentary enlarged sectional view of one of the pushrods according to the present invention.

Referring to FIG. 2, the details of construction of the pushrod can be more clearly seen. The body 12 is constructed of a pultruded tube of a construction as described in U.S. Pat. No. 5,154,146 in which a lengthwise array of fibers of glass, graphite or Kevlar (TM) or a mixture thereof is embedded in a mass of a thermosetting resin such as epoxy.

Details of such construction, materials, and methods are set forth in aforementioned U.S. Pat. No. 5,154,146 and the other patents referenced above, and hence the details thereof are not here set out.

The ends of the body 12 are machined or otherwise shaped to a spherical surface 18 at either end thereof.

The hollow end caps 14 are of a thin-wall metal such as 0.020" thick steel hardened and having an interior spherical surface 20 closely matching the spherical surface 18 of the pushrod. The tip 14 has a skirt portion which extends down below the spherically shaped portion of the tip of the body 12. The tip is bonded thereto as by means of the adhesives and methods described in aforementioned U.S. Pat. No. 5,154,146.

The end cap 14 is preferably formed by a low cost metal working process such as stamping or deep drawing with an oil hole 22 formed therein to allow oil from the internal passage 16 to exit for lubrication purposes and then heat treated to a high degree of hardness.

The resulting construction is very durable in that the entire tip ends of the body 12 are confined such that the brooming and/or cracking failure along the fiber boundary is resisted. At the same time, the end caps 14 are of very light weight such that when combined with the light-weight, rod body 12, an overall very light-weight pushrod results.

The increased surface area available for adhesive bonding improves the strength of the adhesive connection of the end caps 14 to the rod body 12. The cost of the end cap 14 is also minimized.

Figure 3:
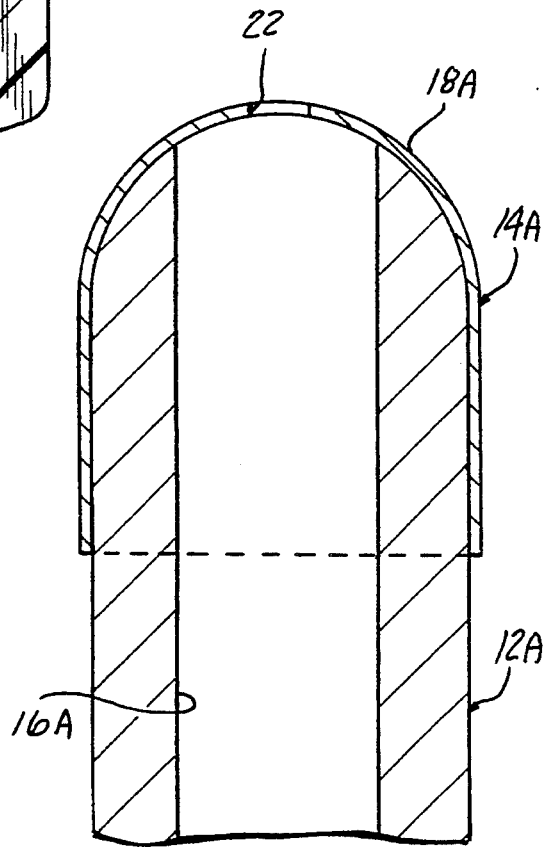
FIG. 3 is an enlarged fragmentary sectional view of the end of a pushrod of all metal construction.

The same concept can be utilized for a steel pushrod in which the pushrod 12A, as shown in FIG. 3, has spherical ends machined thereon, with the end cap 14A affixed thereto as by welding. A lower cost steel body 12A can be thus employed with the hardened, wear resistant steel used in the end cap 14A.

I claim:

1. A composite pushrod for an internal combustion engine valve train comprising an elongated, hollow rod of a composite material comprising a thermosetting resin matrix and an array of fibers extending lengthwise of said hollow rod, said fibers embedded in said resin matrix, at least one end of said hollow rod being preformed with a spherical tip surface;

a hollow end cap comprised of a thin wall metal piece having an internal surface spherically shaped and fitted completely over said preformed spherical tip surface of said hollow rod completely confining all of said fibers embedded in said resin matrix;

said hollow end cap bonded to said preformed spherical tip surface of said at least one end of said hollow rod.

2. The composite pushrod according to claim 1 wherein both ends of said hollow rod are preformed with a spherical tip surface and wherein a pair of thin walled metal hollow end caps each having a preformed spherical tip surface, and are fitted completely over a respective end of said hollow rod and bonded to said preformed spherical tip surface thereof.

* * * * *